US005366217A

United States Patent [19]

Tokuno et al.

[11] Patent Number: 5,366,217

[45] Date of Patent: Nov. 22, 1994

[54] SHEET STACKER

[75] Inventors: Masateru Tokuno, Tokyo; Tatsuyuki Miyagawa, Yokohama, both of Japan

[73] Assignees: SK Engineering, Ltd., Tokyo; Reliance Electric Ltd., Kanagawa, both of Japan

[21] Appl. No.: 777,340

[22] PCT Filed: Oct. 15, 1991

[86] PCT No.: PCT/JP91/01399

§ 371 Date: Dec. 5, 1991

§ 102(e) Date: Dec. 5, 1991

[30] Foreign Application Priority Data

Oct. 19, 1990 [JP] Japan ..... 2-283178

[51] Int. Cl.[5] ..... B65H 43/00

[52] U.S. Cl. ..... 271/176; 271/182; 271/199; 271/202

[58] Field of Search ..... 271/176, 182, 199, 202

[56] References Cited

U.S. PATENT DOCUMENTS

| | | | |
|---|---|---|---|
| 3,507,489 | 4/1970 | Wilshin et al. | 271/182 |
| 3,955,812 | 5/1976 | Suda et al. | 271/182 |
| 4,376,531 | 3/1983 | Breunig | 271/202 |
| 4,436,302 | 3/1984 | Frye et al. | 271/202 |
| 4,486,012 | 12/1984 | Böck et al. | 271/176 |
| 4,577,746 | 3/1986 | Tokuno et al. | 271/202 |
| 4,966,521 | 10/1990 | Frye et al. | 271/202 |
| 4,995,859 | 2/1991 | Totani | 271/182 |
| 5,102,111 | 4/1992 | Reponty | 271/202 |

FOREIGN PATENT DOCUMENTS

| | | | |
|---|---|---|---|
| 210707 | 2/1987 | European Pat. Off. | 271/202 |
| 2141340 | 2/1973 | Germany | 271/202 |
| 45-25604 | 10/1970 | Japan . | |
| 51-38985 | 10/1976 | Japan . | |
| 53-11100 | 4/1978 | Japan . | |
| 61-23147 | 6/1986 | Japan . | |
| 61-136858 | 6/1986 | Japan . | |
| 63-196455 | 8/1988 | Japan . | |

*Primary Examiner*—David H. Bollinger
*Attorney, Agent, or Firm*—McGlew and Tuttle

[57] ABSTRACT

With a sheet stacker to stack sheets cut by a sheet cutter into stacking station, sheets cut by a sheet cutter are transferred by a conveyor with a fixed sheet interval, a clamping device clamps a base position near the tail end of the sheet during transfer of the sheet, and the sheet transfer speed is reduced to an optimum speed needed for stacking the sheet into stacking station orderly. The clamping device has a rotating device having free rolls at its end and a slowdown roll, and clamps the sheet once during each revolution of the rotating device, by contact of the free rolls with the slowdown rolls.

5 Claims, 7 Drawing Sheets

SHEET STACKER

FIELD OF THE INVENTION

This invention relates to a sheet stacker to be used in the field of cutting corrugated cardboard, paper, plastic film, foil and the like and, for slowing down sheet travelling speed to an optimum speed needed for orderly stacking sheets cut by a sheet cutter into a stacking zone by clamping tails of sheets during transferring sheets, and for stacking the sheets directly and orderly into the stacking zone.

BACKGROUND OF THE INVENTION

Conventionally as shown in FIGS. 7A and FIG. 7B, in order to stack sheets of corrugated cardboard, paper, plastic film, foil and other various material cut by a sheet cutting machine 82 into the stacking zone, sheets 86 are transferred by a high speed conveyor 84 and their transfer speed is reduced by an overlap conveyor 88 (a low speed conveyor) having a speed difference from the high speed conveyor. The sheets, whose speed is reduced, are then overlapped on the overlap conveyor one after another, are transferred by the overlap conveyor, and are stacked into the stacking zone, lot by lot overlapped.

Many kinds of overlap conveyors are used. For example, sheets travelling on the high speed conveyor are nipped, slowed down and overlapped on the overlap conveyor by "pressing whiskers" of the overlap conveyor, with vacuum or the like, and are then transferred on the overlap conveyor. Or, sheets transferred by the high speed conveyor are slowed down and overlapped by a "catching belt", "pressing belt", "low speed conveyor" or the like.

FIG. 7A shows an example where pressing whiskers 90 are used, and FIG. 7B shows an example where a catching belt 92 is used.

However, a system using such an overlap conveyor has various problems such that grazes are produced on surface of a sheet travelling at a high speed due to friction of "pressing whiskers", "catching belt", "pressing belt" or the like, the leading edge of sheet is folded or damaged because of high speed sheet transfer by the conveyor, and normally the leading edge of a sheet droops down or bumps against preceding sheet, especially when sheet stiffness is low.

Because cutting performance of cutting machine has recently been improved remarkably, it is required to transfer cut sheets at a high speed. Therefore, it becomes necessary to install another higher speed conveyor upstream of said high speed conveyor, resulting in lengthening a line by said higher speed conveyor, a larger installation space, and an increase of installation cost.

Furthermore, because materials to be cut by a sheet cutting machine vary to include thicker and thinner corrugated cardboard, paper, plastic film, foil and the like, it becomes impossible to solve the various problems for such various materials by a conventional sheet stacker, namely by a stacker for transferring cut sheets by a high speed conveyor, reduction of sheet speed by an overlap conveyor, overlapping the sheets, sending the sheets to the stacking zone and stacking the sheets into the stacking zone, lot by lot overlapped.

A means to remove such problems was disclosed in U.S. Pat. No. 557,439, "Tail Stopping and Knockdown Device". As shown in FIG. 8, this device has a slowing down device comprising a brush roll 103 and a low speed roll 104 between a conveyor 101 and a stacking station 102. The rolls 103 and 104 are driven by a motor 106 through appropriate gearings 105.

In this conventional technology, sheets are slowed down and sent to the stacking station 102. Their portions near the tails ends are contacted by one of two brushes 108 of the brush roll 103 and pressed to the roll 104 rotating at a low speed, when sheets pass between two rolls 103 and 104. But with this type of brush roll 103, the pressing action of brush 108 to press the sheets to the roll 104 is unstable, and the sheets could be damaged by the brushes in case of paper sheets or the like. Furthermore, the pressing positions of sheets cannot be accurately controlled, and therefore, when the pressing positions of sheets are shifted, sheets might not be stacked into the stacking orderly.

SUMMARY AND OBJECTS OF THE INVENTION

It is an object of this invention to provide a sheet stacker to enable to solve these various problems without using conventional overlap conveyor.

The sheet stacker of this invention for stacking sheets cut by a sheet cutter and transferred, into a stacking station, comprising;

- a conveyor for transferring sheets cut by a sheet cutting machine, keeping a fixed sheet interval,
- a clamping device for clamping a base position near the tail end of the sheet during transferring the sheet and reducing sheet travelling speed to an optimum speed needed for stacking the sheet into the stacking station orderly,
- a servo motor for driving the clamping device,
- a servo amplifier for controlling the servo motor,
- a sheet tail end position sensor for detecting the tail end of the sheet being transferred by the conveyor,
- a first speed sensor for detecting the speed of the conveyor,
- a second speed sensor for detecting the rotating speed of the servo motor,
- an origin sensor for detecting the origin of the clamping device,
- a phase setter for setting the base position,
- a first control circuit for performing phase speed equalizing control of the clamping device, based on outputs of the first sensor, the second sensor, the origin sensor, the sheet tail end position sensor and the phase setter, and a second control circuit for performing upper reference point determining control of the clamping device, based on outputs of the second speed sensor and the origin sensor.

The sheet stacker of this invention is featured by the fact that the clamping device has a rotating device having free rolls at its end and a slowdown roll, and that the free rolls contact with the slowdown roll and clamp the sheet once during each revolution of said rotating device.

Furthermore, the sheet stacker of this invention for stacking sheets cut by a sheet cutter and transferred into first and second stacking stations, comprising;

- a conveyor for transferring sheets cut by a sheet cutter, keeping a fixed sheet interval,
- a plurality of first pressing rolls installed on the tail end of the conveyor, a diverter for moving the first pressing rolls up and down, a first clamping device for clamping a base position near the back end of the sheet sent out from the first pressing rolls and reducing the sheet travelling speed to an optimum speed needed for stacking the sheet into the first stacking station orderly, a first guide belt for guiding the sheet sent out from the first clamping device to the second stacking station, a second conveyor for transferring sheets sent out from the first clamping device to the second clamping device described later, a plurality of second pressing rolls installed on the tail end of the second conveyor, a second clamping device for clamping base position near to the tail end of the sheet sent out from the second pressing rolls and reducing the sheet travelling speed to an optimum speed needed for stacking the sheet into the second stacking station orderly, and a second guide belt to guide the sheet sent out from the second clamping device to the second stacking station, whereby the sheet transfer direction is switched from the first stacking station to the second stacking station and vice versa by switching the first pressing rolls up or down by the diverter.

DETAILED DESCRIPTION OF THE PREFERRED EMBODIMENT

Figure 1:
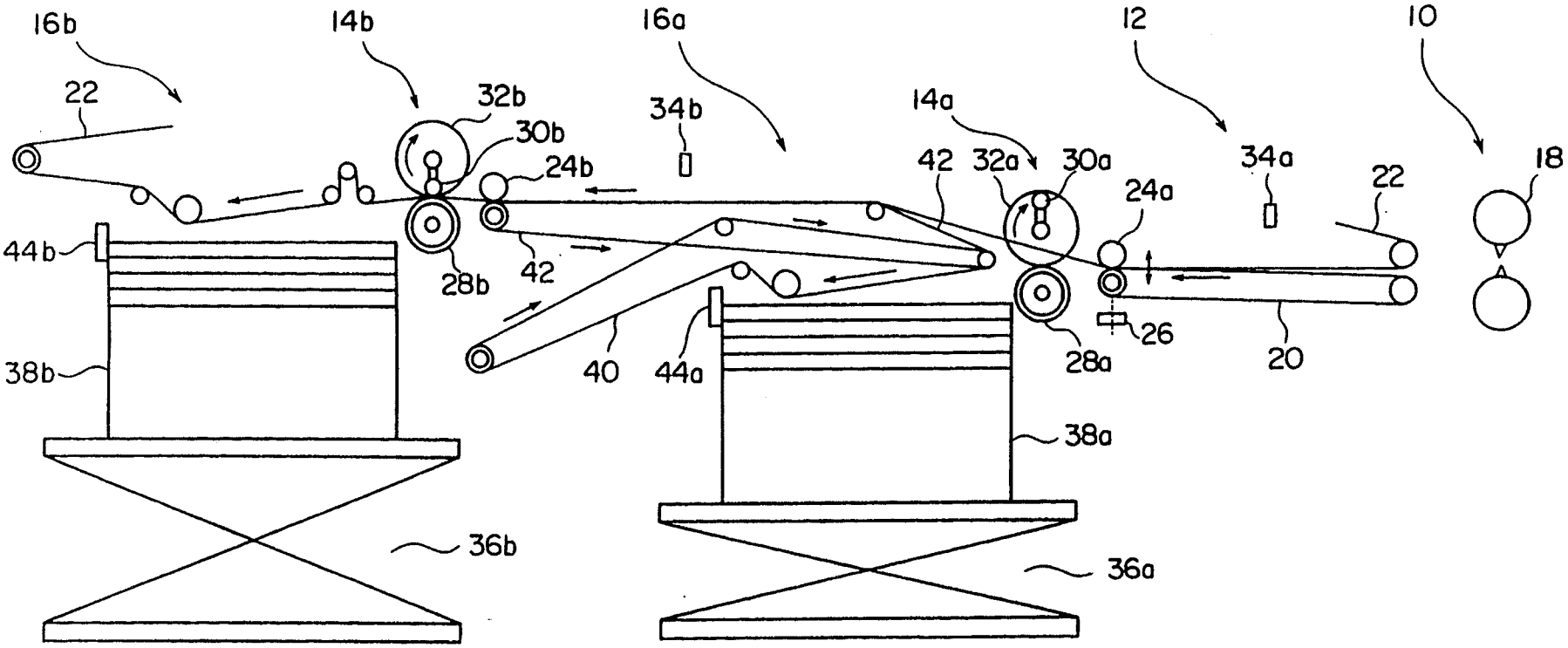
FIG. 1 shows the construction of an embodiment of this invention.

FIG. 1 is a drawing illustrating an embodiment of this invention where two sets of stacking zones are provided for changing skids and order.

This sheet stacker comprises a sheet cutting machine 10, a conveyor system 12 to transfer sheets from the sheet cutting machine, first and second clamping devices 14*a* and 14*b* to clamp sheet tail ends, and first and second stacking zones 16*a* and 16*b* to stack sheets.

The cutting machine 10 has a sheet cutter 18 which cuts corrugated cardboard, paper, plastic film, foil and the like to a specified length.

The conveyor system 12 is disposed downstream of the cutting machine 10 and has a conveyor 20 for transferring sheets, its length being set to longer than maximum cutting length of sheets. Pressing belts 22 consisting of several belts are installed on the conveyor 20, and pressing rolls 24*a* are disposed on the tail end of conveyor 20. These pressing rolls 24*a* are moved up and down by a diverter 26. Also, above the conveyor 20, a sheet tail end position sensor 34*a* is provided to detect the tall end of a sheet travelling on the conveyor 20. The speed of conveyor 20 is set at a few percent higher than a web feeding speed of the cutting machine 10 so that the interval of cut sheets can be expanded.

The first clamping device 14*a* is a device to clamp tail ends of cut sheets. Under it, a slowdown roll 28*a* is installed to slow down sheet speed to an optimum speed and to send out sheets to the first stacking zone 16*a*. At an upper position of the first clamping device 14*a*, there is provided a rotating device 32*a* having free rolls 30*a* at its end to press the cut sheet onto the slowdown roll via intervals of the pressing belts 22 and to equalize the speed of cut sheet to the speed of slowdown roll. For the slowdown roll 28*a*, high-friction rubber roll or the like is used depending on the kind of sheet material.

Figure 2:
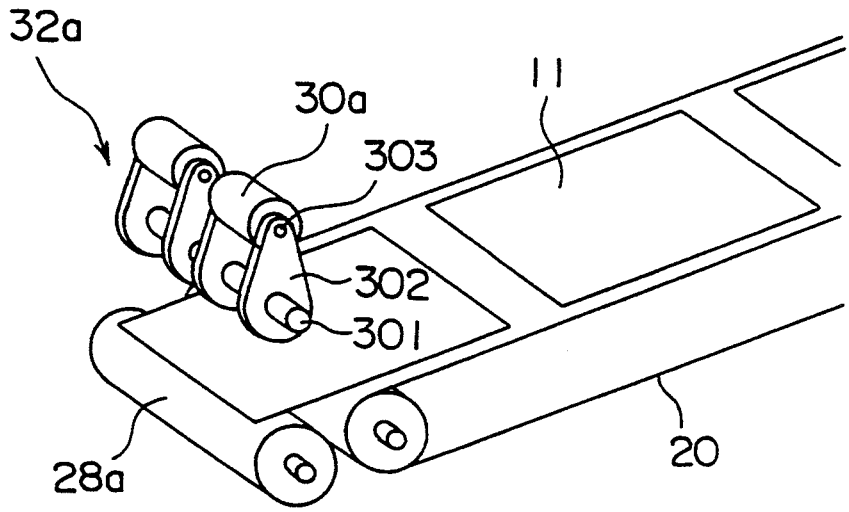
FIG. 2 is an perspective view of the rotating device.

FIG. 2 is a perspective view of the slowdown roll 28*a* and the rotating device 32*a*. The rotating device 32*a* comprises arms 302 fixed to rotating shafts 301, shafts 303 fixed to ends of these arms and free rolls 30*a* supported by these shafts 303 enabling them to rotate freely. Though the figure shows only two free rolls 30*a* in order to simplify the figure, an actual sheet stacker has a plurality of the free rolls.

The rotating speed of the slowdown roll 28*a* is set based on the kind of material of sheet 11, the line speed and the cutting length of sheets. An AC servo motor is controlled so that the arms 302 of the rotating device 32*a* can start tracking at the time when the sheet tail end position sensor 34*a* detects the tail end of a sheet, and that the free rolls 30*a* can press the sheet to the slowdown roll 28*a* via intervals of the pressing belts 22 and can clamp the sheet by equalizing the revolution speed of the free rolls 30*a* about the shafts 301 at a fixed or clamp position present from the base position near the tail end of sheet.

The first stacking zone has a first stacking station 38*a* installed on a first lifter 36*a* which moves up and down, is sheets are stacked to the stacking station.

At the first stacking zone 16*a*, a guide belt 40 to guide sheets to the first stacking station 38*a* and a sheet transfer belt 42 to send sheets to the second clamping device 14*b* are provided. On the tail end of sheet transfer belt 42, pressing rolls 24*b* are provided. Also, above the sheet transfer belt 42, a sheet tail end position sensor 34*b* is installed to detect the tail end of a cut sheet being transferred by the sheet transfer belt 42.

The pressing belts 22 of the conveyor system 12 are provided so that they can run through the first clamping device 14*a*, the first stacking zone 16*a*, the second clamping device 14*b* and the second stacking zone 16*b* via the pressing rolls 24*a*.

A sheet sent out from the conveyor 20 at a high speed travels along the lower surface of guide belt 40 running at the same speed as the pressing belt 22, and when the leading edge of sheet reaches at a certain position before a stopper 44*a* of the stacking station 38*a*, the sheet is clamped by the function of the clamping device 14*a*. It is then slowed down to an optimum speed, stopped by the stopper 44*a* and is stacked into the first stacking station 38*a*. In the first stacking station, the sheet is aligned by side jogging and front jogging and is stacked orderly. Moving down of the lifter is controlled so that the uppermost surface of the stacking pile is always kept at a fixed level by a sensor.

In the above-mentioned stacking operation where sheets are stacked into the first stacking station 38*a* of the first stacking zone 16*a*, the sheets sent out from the conveyor system 12 at a high speed are sent to the stacking station 38a through the first clamping device 14a and along the lower surface of the guide belt 40.

In case that a skid change or order change is to be performed without changing operating speed, the divefret 26 is actuated by a signal of the skid change and moves the pressing rolls 24 up (as shown in the figure). The sheets sent out from the conveyor system 12 at a high speed travel on the upper surface of the sheet transfer belt 42 running at the same speed as the conveyor 20, and are sent to the second clamping device 14b, being pressed by the pressing belt 22.

The second clamping device 14b is a device to clamp the tail end of a cut sheet, has at a lower position of the device a slowdown roll 28b to slow down the sheet to an optimum speed and to send out the sheet to the second stacking zone 16b, and has at an upper position of the device a rotating device 32b having free rollers 30b to press the sheet tail end to the slowdown roll via the intervals of the pressing belts 22 and to equalize the speed of sheets to the speed of slowdown roll. Because the functions of second clamping device are same as those of first clamping device, the description of the second clamping device is omitted here.

The second stacking zone 16b has a second stacking station 38b placed on a second lifter 36b movable up and down and a stopper 44b.

A sheet sent out from the sheet transfer belt 42 at a high speed travels along the lower surface of the pressing belt 22 in the stacking zone 16b, and when the leading edge of sheet reaches at a certain position before the stopper 44b of the stacking station 38b, the sheet is clamped by the actions of the second clamping device 14b. It is then slowed down to an optimum speed, stopped by the stopper, and is stacked into the second stacking station 38b. In the second stacking station 38b, the sheet is aligned by side jogging and is stacked orderly. Moving down of the lifter is controlled so that the uppermost surface of the stacking pile is kept at a certain level by sensor.

Figure 3:
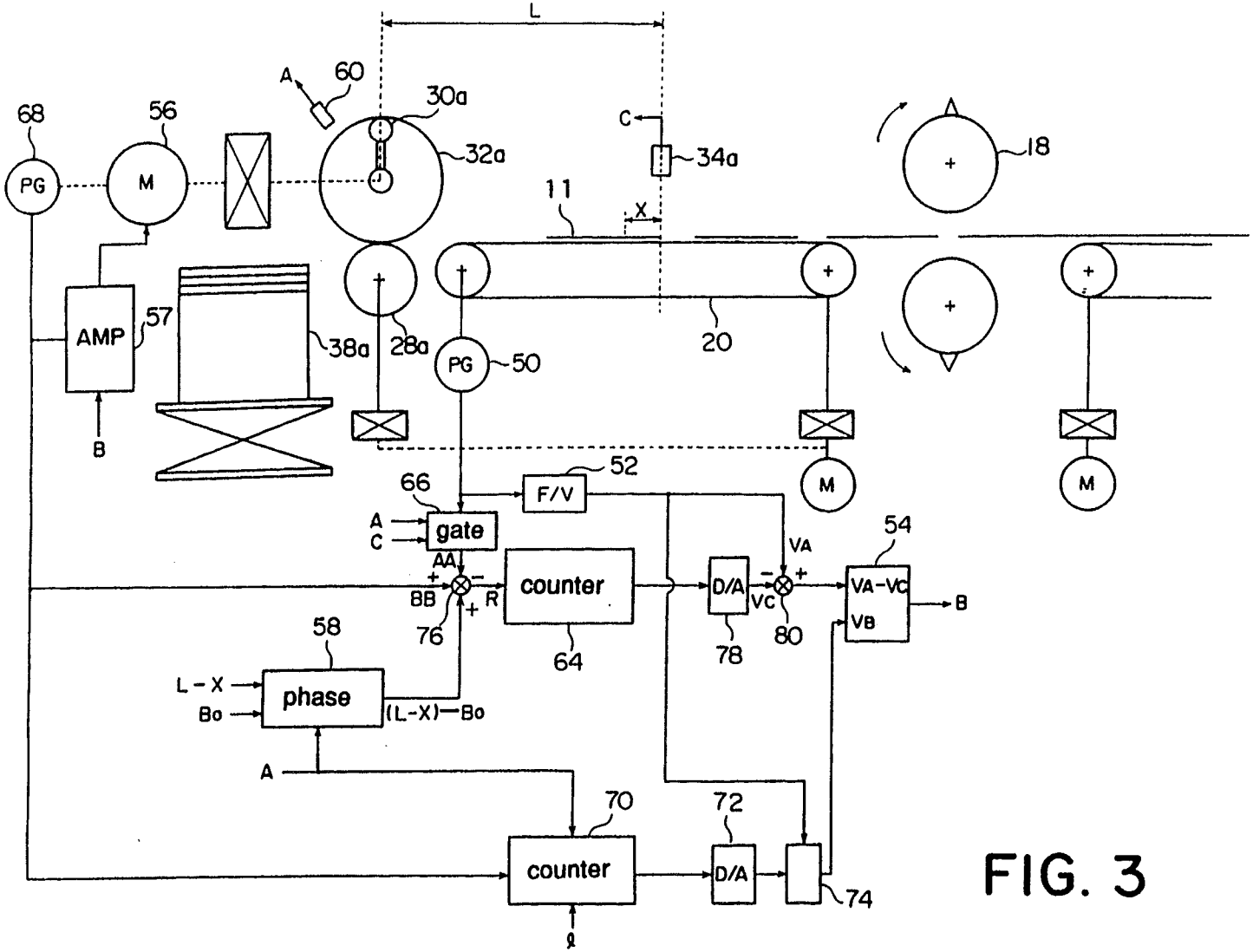
FIG. 3 is a control diagram of the sheet stacker shown in FIG. 1.

Now, the control system of the sheet stacker of this embodiment is explained with reference to FIG. 3. FIG. 3 shows a control system for the first conveyor system 12, the first clamping device 14a and the first stacking zone shown in FIG. 1. Because the control system for the second clamping device 14b and the second stacking zone 16b is same as that for the first clamping device 14a and the first stacking zone 16a, only the control system for the first clamping device 14a and the first stacking zone 16a is described here as representative.

The control is divided into phase speed equalizing control and upper reference point determining control.

The phase speed equalizing control is to control and equalize the revolution speed of free rolls 30a about the shafts 301 to the sheet transfer speed by clamping a sheet at a specific position from the sheet tail end by the free rolls, when the rotating device 32a clamps the sheet 11.

The phase control is performed as follows. Phase setter 58 is preset at the value of (L-X) which is obtained by subtracting the distance (X) between the tail end position of the sheet 11 and the clamping position, from the distance (L) between the lower reference point of the rotating device 32a and the sheet tail end position sensor 34a. This is the phase setting that is to set the phase setter 58 to the value or phase distance of (L-X)-$B_0$ after converting to pulse, based on the slowdown position signal A (the signal showing slowdown starting position located at an angle of 90° from the lower reference point of the rotating device) obtained from the origin detected by the origin sensor 60 installed near the rotating device 32a. The value of $B_0$ is a circumferential length of the circle drawn by the farmost point from the revolution center when the free rolls 30a of the rotating device 32a revolves about the shafts 301. The sheet transfer length is obtained by opening the gate 66 by the signal C generated when the sheet tail end position sensor 34a detects the tail end of a sheet, by inputting to the adder 76 the pulse from the pulse generator (PG) 50 as a subtracting input, and by closing the gate 66 by the slowdown position signal A. The adder 76 subtracts pulses AA indicating the sheet transfer length passed while gate 66 is opened. When the free rolls 30a of the rotating device 32a reach at the target clamping position which is the position to start acceleration, the rotating device starts acceleration, and then, before the free rolls 30a contact the sheet 11, speed equalization is performed by the speed equalizing functions described later and simultaneously, phase adjustment is performed by the following equation. The value R of position deviation counter 64 is expressed by the following equation.

$$R=((L-X)-B_0)-AA+BB$$

where BB is the count value of pulse from the pulse, generator (PG) 68 installed at the AC servo motor to drive the clamping device (count-base slowdown start point).

This calculation is performed by the adder 76, and the position deviation counter 64 keeps the value R. Because the phase control aims to make the deviation zero, the value of R in the above equation finally becomes zero. Because the value of BB finally corresponds to one revolution of the rotating device, the value of BB becomes equal to the value of $B_0$. From this relation and the relation of R=O, therefore, the relation of AA=(L−X) is obtained, and it becomes possible to set the value of AA, i.e. the clamping position to a position X from the sheet tail end.

The speed equalizing control is performed as follows. The deviation R is converted to an analog signal $V_c$. Furthermore, the frequency of pulses generated by the pulse generator 50 installed at the conveyor system 20 is converted to voltage signal by frequency/voltage (F/V) converter 52, and thus, the line speed i.e. the travelling speed of sheet 11 is detected and is sent to the adder 80 as an adding input. The output of adder 80 ($V_A$-$V_C$) is sent to the servo amplifier 57 of the AC servo motor 56 for driving the rotating device 32a as a command for phase equalization through speed command selecting circuit, 54 described later. When R=O, $V_C$ becomes zero and the speed command ($V_A$-$V_C$) becomes equal to $V_A$, and thus, the revolution speed of the free rolls about the shafts 301 is equalized to the sheet travelling speed.

Figure 4:
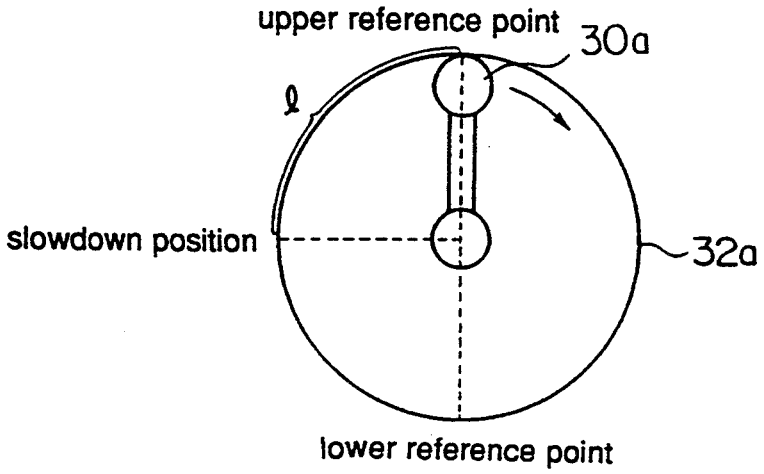
FIG. 4 is a drawing showing position relationship oil the rotating device.

The upper reference point determining control is provided to have the free rolls 30a of the rotating device 32a wait for arrival of a sheet as shown in FIG. 4 when sheets are not supplied continuously. By the slowdown position signal A from the origin sensor 60, the upper reference point deviation counter 70 is set to the circumferential length up to the upper reference point, and after subtracting the pulses from the pulse generator 68, produces a speed command $V_B$ through a D/A converter 72 and a speed command clamp circuit 74. When the position at zero count is determined, the rotating device 32a is stopped at the upper reference point.

The above-mentioned speed command ($V_A$–$V_C$) for the phase speed equalizing control and the speed command $V_B$ for the upper reference point determining control are sent to the speed command selecting circuit (higher voltage selecting circuit) 54, which selects a higher voltage of command and outputs a speed command B to the servo amplifier 57.

Figure 5:
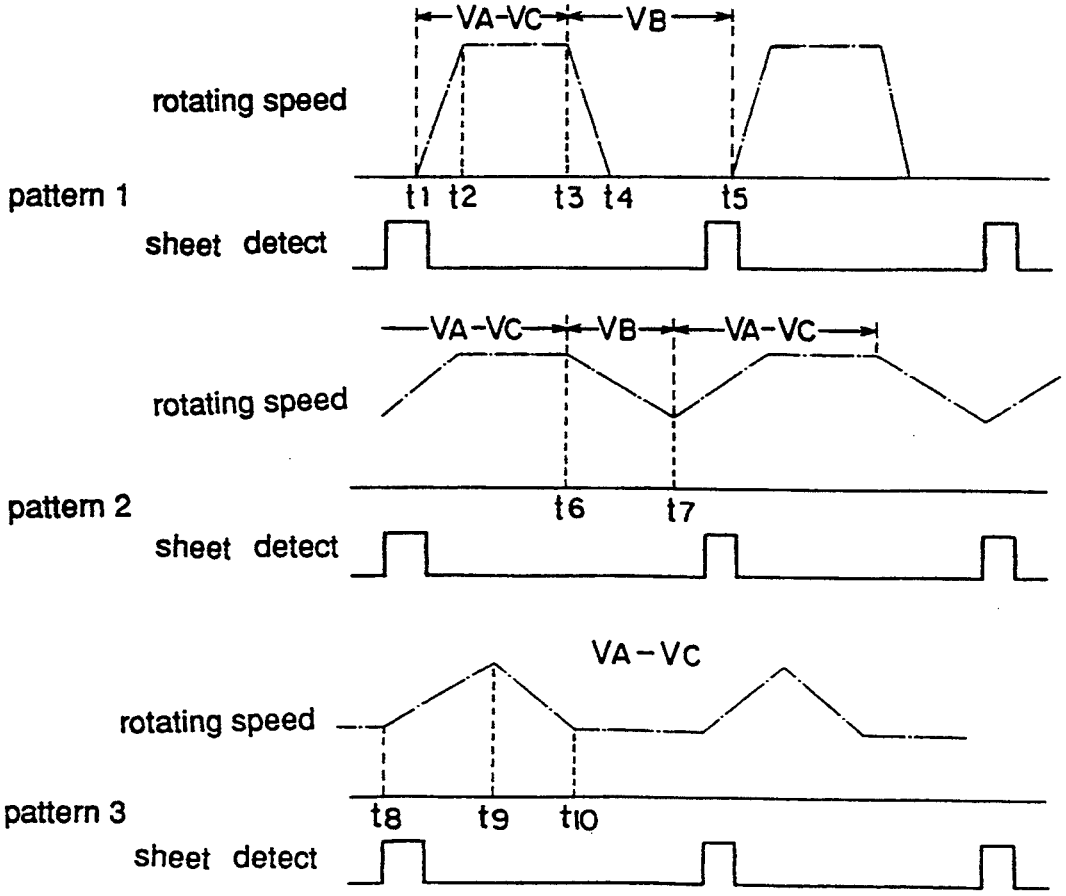
FIG. 5 shows speed patterns of the rotating device.

The speed pattern of the rotating device is either pattern 1, 2 or 3 shown in FIG. 5 depending on the sheet interval.

The pattern 1 is for a longer sheet interval. When the sheet tail end position sensor 34a detects a sheet tail end at time t1, the rotating speed of the rotating device is accelerated by the speed command ($V_A$–$V_C$) and reaches at the line speed at time t2, and the rotating device keeps this speed until time t3. After the time t3, the speed command is switched to the speed command $V_B$ and slows down the rotating device, which arrives at the upper reference point at time t4 and stops at the upper reference point until time t5 when the tail end of the next sheet is detected.

The pattern 2 shows the case that the next sheet arrives before the rotating device stops at the upper reference point. In this case, when the tail end of a sheet is detected, the rotating device is controlled by the speed command ($V_A$–$V_C$) until time t6, and is controlled by the speed command $V_B$ from time t6 to time t7.

The pattern 3 shows the case that sheet interval is shorter than the set length of (L-X). In this case, the rotating device is controlled by the speed command ($V_A$–VC), starts to be accelerated from the line speed at time t8, starts to be slowed down at time t9, and is equalized to the line speed at time t10.

Figure 6:
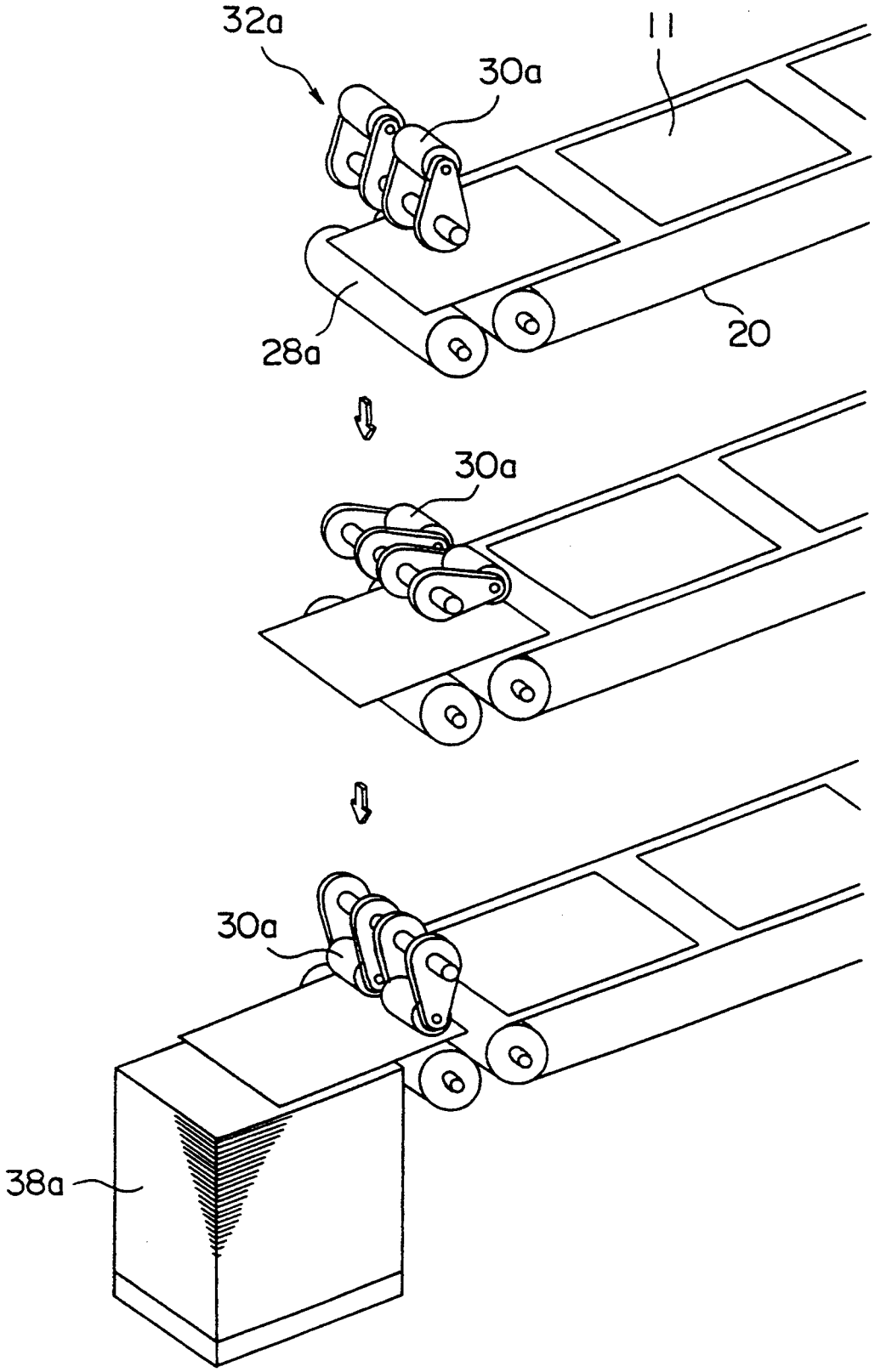
FIG. 6 is a drawing describing movement of the rotating device.
Figure 7A:
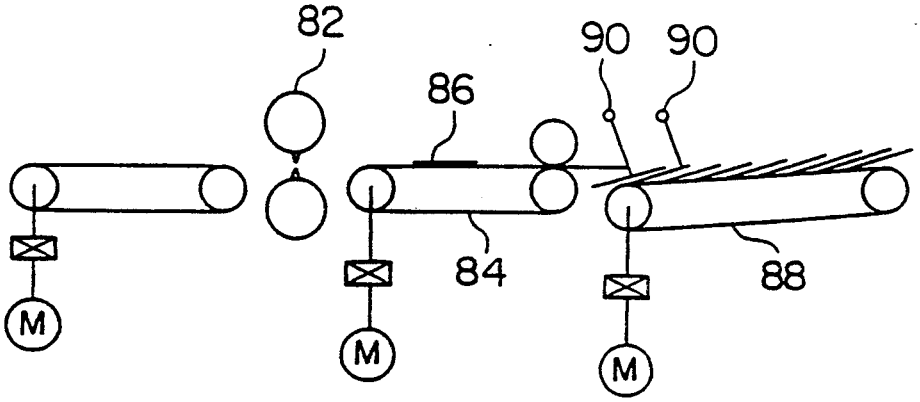
(PRIOR ART) FIG. 7A
FIGS. 7A and FIG. 7B are drawings to describe conventional technologies.
Figure 7B:
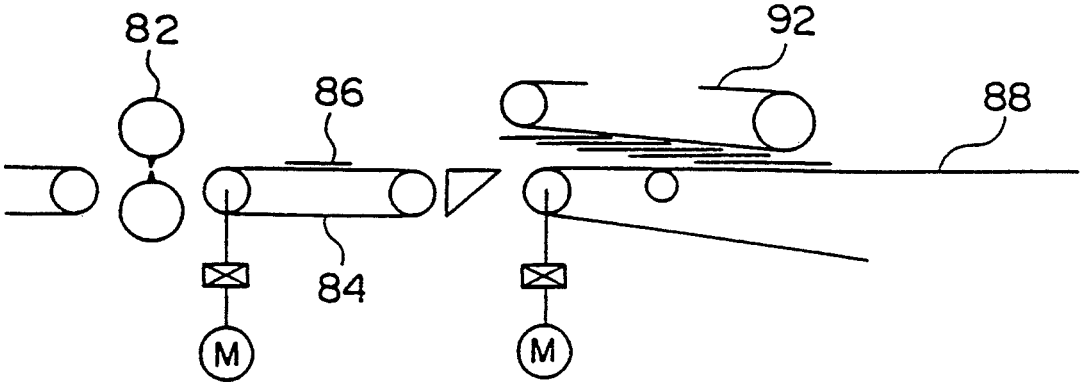
(PRIOR ART) FIG. 7B
Figure 8:
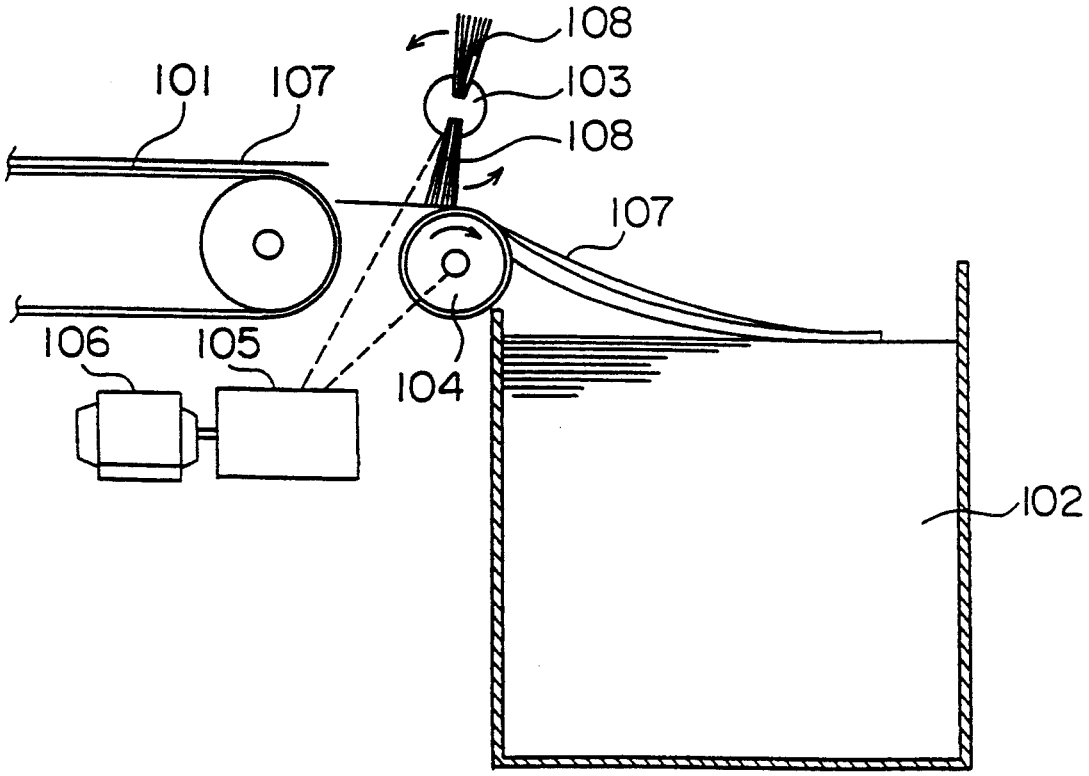
(PRIOR ART) FIG. 8
FIG. 8 is a drawing to describe another conventional technology.

Now, the behavior of the pattern 1 explained, with reference to FIG. 6, which shows the revolution of the free rolls 30a of the rotating device 32a.

A sheet 11 cut by a sheet cutter is transferred by the conveyor 20 towards the first stacking zone 16a. When the sheet tail end position sensor detects the tail end of sheet 11, the gate 66 is opened, the pulses AA generated by the pulse generator 50 is sent to the adder 76, the free rolls 30a, which were stopping at the upper reference point as shown in the upper figure of FIG. 6, start to be accelerated by the speed command ($V_A$–$V_C$) as shown in the middle figure of FIG. 6, and the speed equalization is performed. When the deviation R of the deviation counter 64 becomes zero, the free rolls 30a clamp the sheet at the clamping position located at a position X from the sheet tail end, slow down the sheet and send it to the stacking station 38a.

When the free rolls 30a arrive at the slowdown point, the speed command is switched to the speed command $V_B$, and the free rolls 30a start to be slowed down and stop at the upper reference point.

In the above, the case of the pattern 1 in FIG. 5 was described. The behaviors of the remaining patterns 2 and 3 could be understood easily by persons skilled in the art.

INDUSTRIAL APPLICABILITY

Because a sheet stacker of this invention can slow down sheet transfer speed to an optimum speed regardless of cutting length of sheet cut off by a cutter, by clamping a base position near the tail end of a travelling cut sheet and can stack the sheet directly without overlapping sheets, production or grazes caused by friction of sheet surfaces due to overlapping can be eliminated, and also length of sheet transfer conveyor downstream of the cutter can be shortened.

Furthermore, a sheet stacker of this invention has an effect to enable to send sheets to be stacking station normally, even if various kinds of sheet materials are handled.

We claim:

1. A device for slowing down sheets, the device comprising:

conveyor means for moving the sheets at a conveyor speed and with the sheets separated at a predetermined interval;

clamping means positioned downstream of said conveyor means and for receiving the sheets from said conveyor means, said clamping means including a slowdown roll rotating at a stacking speed and positioned on a first side of the sheets, said clamping means also including a rotating device with a rotating shaft, a rotating arm connected on one end to said rotating shaft and a free roll rotatably connected to another end of said rotating arm, said clamping means clamping the sheets between said free roll and said slowdown roll once during a complete rotation of said rotating shaft and at a clamping position on the sheets, said clamping position being spaced from a tail end of the sheets, said clamping means slowing the sheets from said conveyor speed to said stacking speed by said clamping between said free roll and said slowdown roll;

servo motor means connected to said rotating shaft and for driving said rotating shaft;

tail end position sensor means installed on said conveyor means and for detecting the tail end of the sheets as the sheets move along said conveyor means;

conveyor speed sensor means for detecting a speed of said conveyor means:

motor speed sensor means for detecting a speed of said servo motor means:

arm position sensor means for detecting when said rotating arm passes a predetermined point;

position control means for controlling said servo motor means to control rotation of said rotating shaft, said position control means controlling said servo motor means to have said free roll contact the sheets at said clamping position when said clamping position is adjacent said slowdown roll, said position control means controlling said servo motor means dependent on information from said tail end position sensor means, said conveyor speed sensor means, said motor speed sensor means and said arm position speed sensor means.

2. A device in accordance with claim 1, further comprising:

phase setter means for calculating a phase distance from said free roll including circumferential travel distance of said free roll to said clamping position on the sheets when the tail end of the sheets pass said tail end position sensor means;

speed control means for controlling said speed of said servo motor means to have a circumferential speed of said free roll about said rotating shaft substantially equal said conveyor speed when said free roll contacts said clamping position on the sheets, said speed control means controlling said servo motor means dependent on information from said tail end position sensor means, said conveyor speed sensor means, said motor speed sensor means, said arm position speed sensor means, and said phase setter means;

reference point control means for controlling said servo motor means to have said free roll move to a reference point and wait for arrival of one of the; sheets from said conveyor means.

3. A device for slowing down sheets, the device comprising:

conveyor means for moving the sheets at a conveyor speed and with the sheets separated at a predetermined interval;

clamping means positioned downstream of said conveyor means and for receiving the sheets from said conveyor means, said clamping means including a slowdown roll rotating at a stacking speed and positioned on a first side of the sheets, said clamping means also including a rotating device with a rotating shaft, a rotating arm connected on one end to said rotating shaft and a free roll rotatably connected to another end of said rotating arm, said clamping means clamping the sheets between said free roll and said slowdown roll once during a complete rotation of said rotating shaft and at a clamping position on the sheets, said clamping position being spaced from a tail end of the sheets, said clamping means slowing the sheets from said conveyor speed to said stacking speed by said clamping between said free roll and said slowdown roll;

servo motor means connected to said rotating shaft and for driving said rotating shaft;

tail end position sensor means installed on said conveyor means and for detecting the tail end of the sheets as the sheets move along said conveyor means;

conveyor speed sensor means for detecting a speed of said conveyor means and a sheet transfer length;

motor speed sensor means for detecting a speed of said servo motor means and a traveled distance of said free roll;

arm position sensor means for detecting when said rotating arm passes a predetermined point;

phase setter means for calculating a phase distance from said free roll including circumferential travel distance of said free roll to said clamping position on the sheets when the tail end of the sheets pass said tail end position sensor means, said phase distance being substantially equal to a distance L which is a distance from said slowdown roll to said tail end position sensor means, minus a distance X which is from the tail end of the sheets to said clamping position, and then minus a distance Bo which is a circumferential length of said free roll rotated about said rotating shaft;

gate circuit means for gating an output from said conveyor speed sensor means, said gate circuit means being open when the tail end of one of the sheets is detected by said tail end position sensor means, said gate circuit means being closed when said arm position sensor means indicates that said rotating arm has past said predetermined point;

first adder means for determining a deviation by adding said phase distance from said phase setter means with said traveled distance from said motor speed sensor and then subtracting said sheet transfer length received from said conveyor speed sensor means after said sheet transfer length has past through said gate circuit means;

a first digital to analog converter for converting said deviation into an analog signal Vc;

a frequency to voltage converter for converting said speed of said conveyor means into an analog signal Va;

a second adder for calculating a first speed command by subtracting Vc from Va;

a subtractor loaded with a predetermined slowdown distance of said free roll from said predetermined point of said rotating arm to a reference point where said free roll waits for arrival of one of the sheets from said conveyor means, said subtractor subtracting said traveled distance of said free roll from said predetermined slowdown distance when said arm position sensor means detects said rotating arm passing said predetermined point;

a second digital to analog converter for converting an output of said subtractor to a second speed command Vb;

speed command selecting circuit for selecting the higher of said first and second speed commands and sending said higher speed command to said servo motor means.

4. A method for slowing down a sheet, the method comprising the steps of:

providing conveyor means for moving the sheet at a conveyor speed;

providing clamping means positioned downstream of said conveyor means and for receiving the sheets from said conveyor means, said clamping means including a slowdown roll rotating at a stacking speed and positioned on a first side of the sheet, said clamping means also including a rotating device with a rotating shaft, a rotating arm connected on one end to said rotating shaft and a free roll rotatably connected to another end of said rotating arm;

rotating said rotating shaft in a complete revolution to clamp the sheet between said free roll and said slowdown roll at a clamping position on the sheet, said clamping position being spaced from a tail end of the sheets, said clamping slowing the sheets from said conveyor speed to said stacking speed;

detecting the tail end of the sheet at a tail end point on said conveyor means;

generating conveyor pulses representing speed and distance traveled of said conveyor means;

generating rotating shaft pulses representing a speed and distanced traveled of said rotating shaft;

detecting when said rotating arm passes a predetermined point;

determining a phase distance between a circumferential length said free roll must travel about said rotating shaft to move against said slowdown roll and an arrival length from said slowdown roll to said clamping position on the sheet, said determining of said phase distance occurring when said tail end of the sheet passes said tail end point;

updating said phase distance with said conveyor pulses and said rotating shaft pulses after said tail end of the sheet passes said tail end point;

converting said updated phase distance into a phase speed signal;

converting said conveyor pulses into a conveyor speed signal;

subtracting said phase speed signal from said conveyor speed signal to form a speed command;

rotating said rotating shaft in accordance with said speed command to cause said free roll to move against said slowdown roll when said conveyor means moves the clamping position of the sheet adjacent said slowdown roll, said speed command also rotating said rotating shaft to cause said free roll to have a circumferential speed substantially equal to said conveyor speed.

5. A method in accordance with claim 4, further comprising the steps of:

determining a slowdown length from said predetermined point of said rotating arm to a reference point where said rotating arm can wait until another sheet is moved by said conveyor means;

recording said rotating shaft pulses when said rotating arm passes said predetermined point;

stopping said rotating shaft when said recorded rotating shaft pulses substantially equals said slowdown length.

position control means for controlling said servo motor means to control rotation of said rotating shaft, said position control means controlling said servo motor means to have said free roll contact the sheets at said clamping position when said clamping position is adjacent said slowdown roll, said position control means controlling said servo motor means dependent on information from said tail end position sensor means, said conveyor speed sensor means, said motor speed sensor means and said and position speed sensor means.

* * * * *